US006496123B2

(12) United States Patent
Brinkman

(10) Patent No.: US 6,496,123 B2
(45) Date of Patent: Dec. 17, 2002

(54) PORTABLE TRAFFIC LIGHT

(75) Inventor: Gordon E. Brinkman, Jellicoe (CA)

(73) Assignee: WWS Leasing, Jellicoe (CA)

( * ) Notice: Subject to any disclaimer, the term of this patent is extended or adjusted under 35 U.S.C. 154(b) by 0 days.

(21) Appl. No.: 09/975,010

(22) Filed: Oct. 12, 2001

(65) Prior Publication Data

US 2002/0075169 A1 Jun. 20, 2002

(30) Foreign Application Priority Data

Dec. 14, 2000 (CA) ..... 2328517

(51) Int. Cl.[7] ..... G08G 1/095

(52) U.S. Cl. ..... 340/908; 340/907; 340/471; 340/473; 362/523; 362/549; 362/84; 116/202

(58) Field of Search ..... 340/908, 907, 340/932.1, 471, 472, 473, 431; 362/485, 486, 487, 504, 505, 523, 549, 84, 540, 191, 418, 431; 116/63 R, 63 P, 202

(56) References Cited

U.S. PATENT DOCUMENTS

| | | | | |
|---|---|---|---|---|
| 3,883,846 A | * | 5/1975 | Bruner | 40/550 |
| 3,886,519 A | | 5/1975 | Hovland | |
| 3,995,250 A | | 11/1976 | Ferree | |
| 4,032,883 A | | 6/1977 | Gibson | |
| 4,077,144 A | | 3/1978 | Smits | |
| 4,087,785 A | | 5/1978 | Dodich | |
| 4,401,969 A | | 8/1983 | Green et al. | |
| 4,430,638 A | | 2/1984 | Parker | |
| 4,543,905 A | | 10/1985 | McKenney | |
| 4,593,265 A | | 6/1986 | McKenney | |
| 4,616,225 A | | 10/1986 | Woudenberg | |

(List continued on next page.)

FOREIGN PATENT DOCUMENTS

| | | |
|---|---|---|
| AU | 703322 AU B | 3/1999 |
| CH | 686048 A5 | 12/1995 |
| CN | 1200524 A | 12/1998 |
| FR | 2727994 A1 | 6/1996 |
| GB | 2306242 B | 4/1997 |
| JP | 9069769 A | 3/1997 |

OTHER PUBLICATIONS

2000 ADDCO, Inc., *traffic control group*, PTS–2000 Solar Portable Traffic Signal, Jul. 7, 2000, internet pp. 1–2 www.addcoinc.com/t_port.htm, St. Paul, Minnesota, USA.

Horizon Signal Technologies, *Portable Traffic Lights*, Jun. 18, 2000, SQ2 System, SQ5 System, internet pages (4), www.horizonsignal.com/, Wayne, Pennsylvania, USA.

Highway Special Ties L.L.C., *Equipment Rental*, Solar Portable Traffic Signals, Jul. 7, 2000, internet pages (3), www.highwayspecialties.com/, Salem, Oregon, USA.

*Primary Examiner*—Jeffery Hofsass
*Assistant Examiner*—Toan Pham
(74) *Attorney, Agent, or Firm*—Aikins, MacAulay & Thorvaldson; Murray E. Thrift

(57) ABSTRACT

A roadwork safety unit mounts on the receiver hitch of a vehicle and connects to the conventional trailer lighting coupling. The unit includes a carrier for carrying the usual equipment to a site where the safety unit is to be used, for example cones, picks, shovels, rakes and pole-mounted signage. The carrier also carries a telescopically extendible standard supporting a light unit that includes a red stop light and a flashing amber warning light. The lights may be operated by a traffic control person also handling the pole-mounted signage. The unit is quickly and easily mounted on a vehicle for transport to a roadwork site and can be transported along the road with moving roadworks. Floodlights are mounted on the standard to illuminate the area beside the vehicle where the traffic control person would normally be standing. This provides added visibility and safety in night use.

12 Claims, 5 Drawing Sheets

U.S. PATENT DOCUMENTS 4,706,087 A 11/1987 Holznagel
4,744,590 A * 5/1988 Chesney ..... 280/769
4,777,751 A 10/1988 Pasquale
4,800,471 A * 1/1989 Lipport ..... 362/80
4,992,788 A 2/1991 Arndt
5,010,336 A 4/1991 Mosele et al.
5,091,828 A 2/1992 Jincks et al.
5,134,385 A 7/1992 Coleman
5,208,584 A 5/1993 Kaye et al.
5,214,793 A 5/1993 Conway et al.
5,252,969 A 10/1993 Kishi
5,257,020 A * 10/1993 Morse ..... 340/908.1
5,294,138 A 3/1994 Yang
5,475,386 A 12/1995 Luoma
5,550,333 A * 8/1996 Whiteman, Jr. ..... 181/204
5,596,944 A * 1/1997 Massie ..... 116/28 R
5,633,629 A 5/1997 Hochstein
5,805,081 A 9/1998 Fikacek
6,302,567 B1 * 10/2001 Gamble, Sr. ..... 362/505

* cited by examiner

PORTABLE TRAFFIC LIGHT

FIELD OF THE INVENTION

The present invention relates to the field of traffic control and more particularly to warning systems used in temporary traffic control on highways.

BACKGROUND

Traditional traffic control for highway roadworks and the like is a traffic control person (TCP) or "flagger", that is an individual with a hand-held sign or flag signalling the traffic to slow down or stop for roadworks or other activity ahead. TCP's and their hand-held signs are with some frequency not seen or heeded by drivers, leading to significant dangers to the TCP and all others in the vicinity.

In some cases, where elaborate and relatively long-term roadworks are undertaken, it is useful to install portable traffic lights. These are usually self-powered units carried on trailers. They have conventional red, green and amber lights controlled in sequence. These portable traffic lights are usually set up in pairs to control alternating one-way traffic on a stretch of road. This requires either communication between the two units or very precise timing of the signals.

In many cases, for example with mobile roadworks and short-term roadworks or traffic accidents, traffic control must be established quickly and must be quite mobile. The prior art portable traffic lights are unsuitable for this purpose because of the length of time that it takes to set them up and their lack of mobility. The present invention addresses these concerns.

SUMMARY

According to the present invention there is provided a roadwork safety unit for use with a road vehicle having a trailer hitch, a vehicle electrical system and a trailer wiring connector connected to the vehicle electrical system, said safety unit comprising:

- a hitch connector for connection to the trailer hitch;
- a light unit mounted on the hitch connector and including:
  - an upright standard; and
  - a light head mounted on the standard; and
- a light operating electric circuit connecting the electrical connector and the light head, the circuit including:
  - an electrical connector connectable to the trailer wiring connector;
  - a switch for selectively controlling the supply of electricity from the electrical connector to the light head.

This safety unit is readily mounted on a road vehicle with appropriate trailer fittings. These may be a standard receiver type hitch and a conventional connector for trailer lighting. This makes the unit highly mobile, and capable of being put into use immediately upon arrival at a site.

In preferred embodiments, the safety unit includes a base mounting the light standard on the hitch connector at a position offset to one side, so as to be adjacent one side of the transporting vehicle. The light unit itself may be mounted on the standard by an offset bracket for rotation from a transport position behind the vehicle to an in use position projecting to one side of the vehicle. It is also possible to make the standard telescopic, so that the light unit may be lowered for transport purposes.

The preferred base includes a carrier that may be used to transport flag signs, cones, shovels, picks and other items that may be required at a site where the unit is to be used.

It has been found that a flashing amber light and a steady red light provide a good advance warning to drivers. For night use it is useful to have one or more floodlights mounted on the standard to illuminate the area beside the vehicle where a TCP would normally be standing.

The safety unit is preferably equipped with a remote control handset, linked to the remainder of the light operating system through a long flexible cord. This allows the light to be operated by a TCP at any convenient location, including on the road or even sitting in the vehicle under the appropriate circumstances.

Further safety is provided by a yellow and black checkered panel mounted on the back side of the carrier.

BRIEF DESCRIPTION OF THE DRAWINGS

In the accompanying drawings, which illustrate an exemplary embodiment of the present invention.

DETAILED DESCRIPTION

Figure 1:
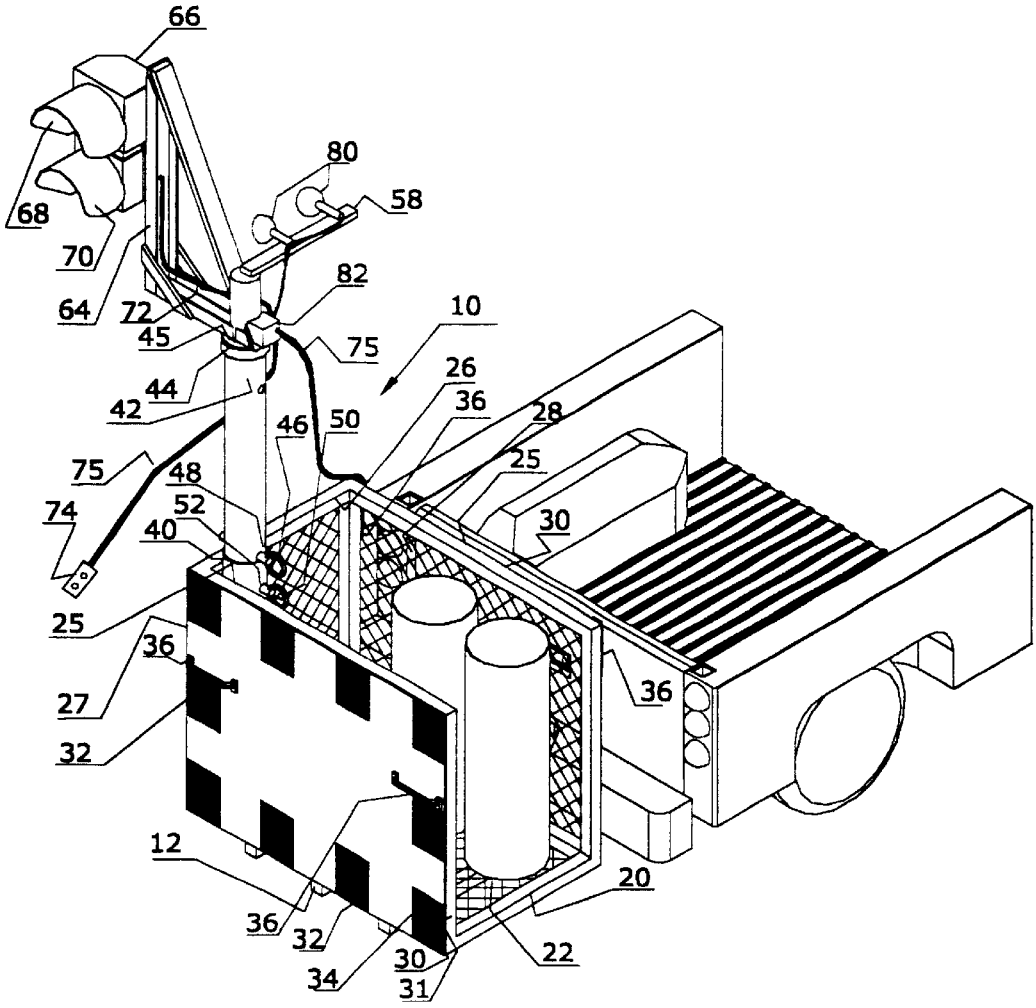
FIG. 1 is an isometric view of a safety unit according to the present invention.
Figure 2:
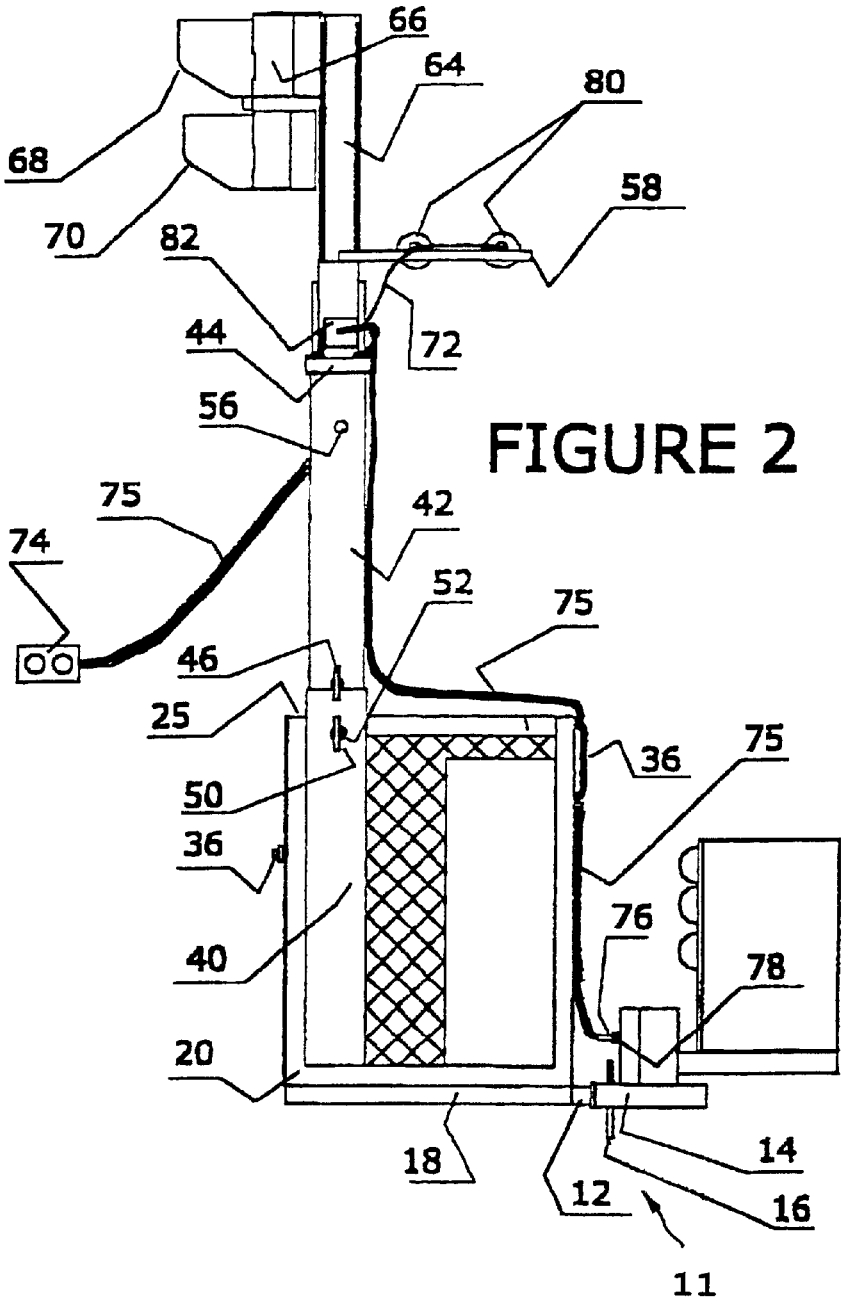
FIG. 2 is a side view of the unit.
Figure 3:
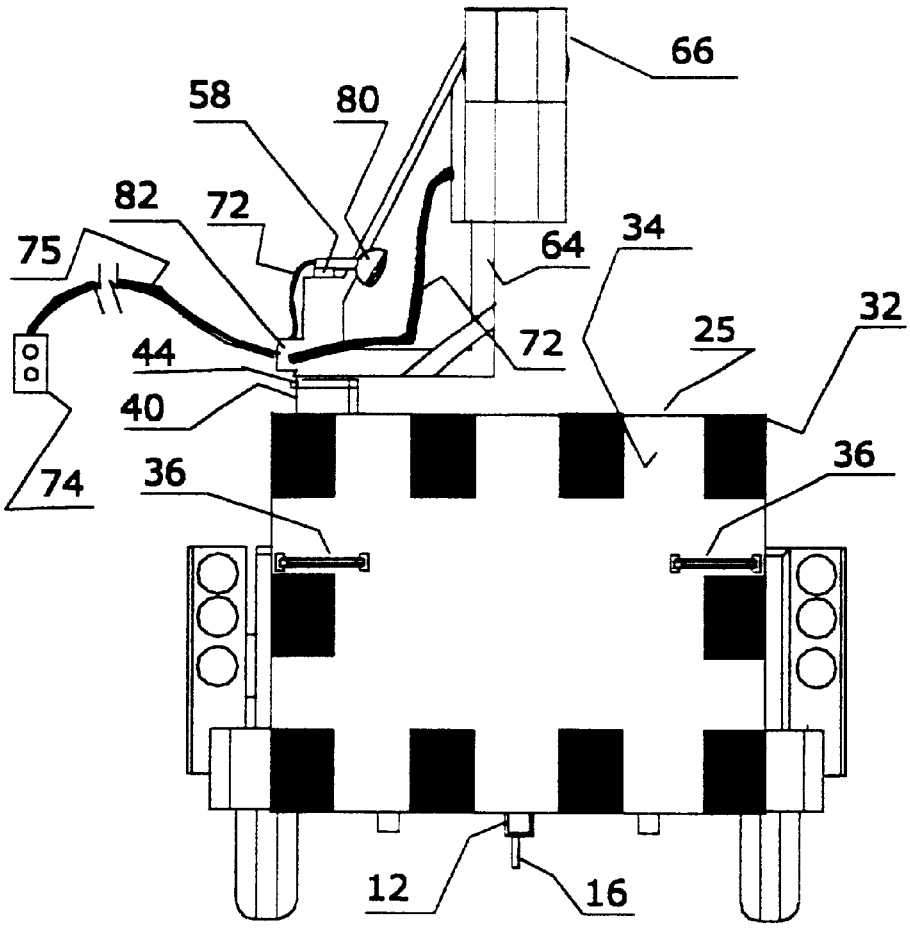
FIG. 3 is a back view of the unit in the transport position.
Figure 4:
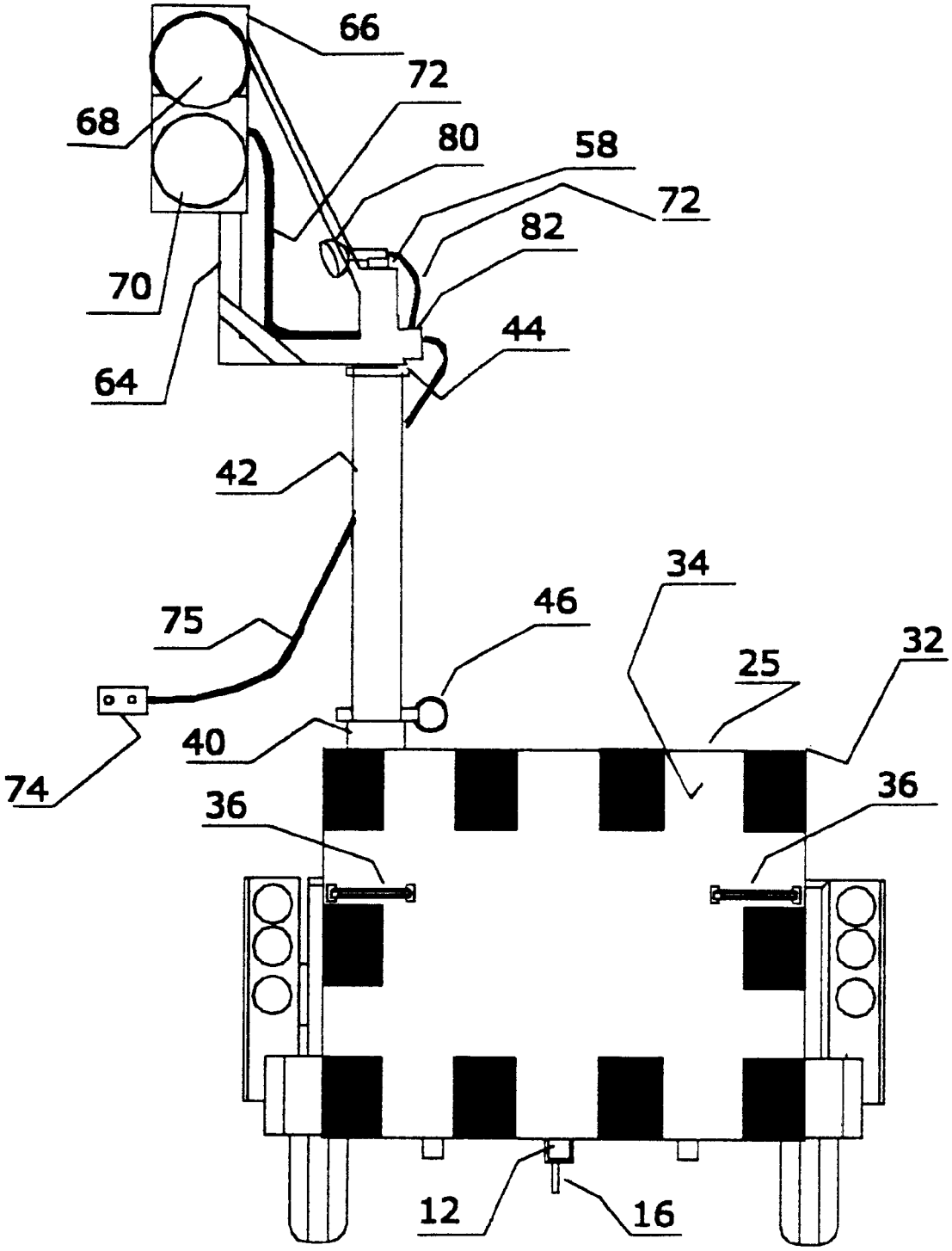
FIG. 4 is a back view of the unit in the use position.
Figure 5:
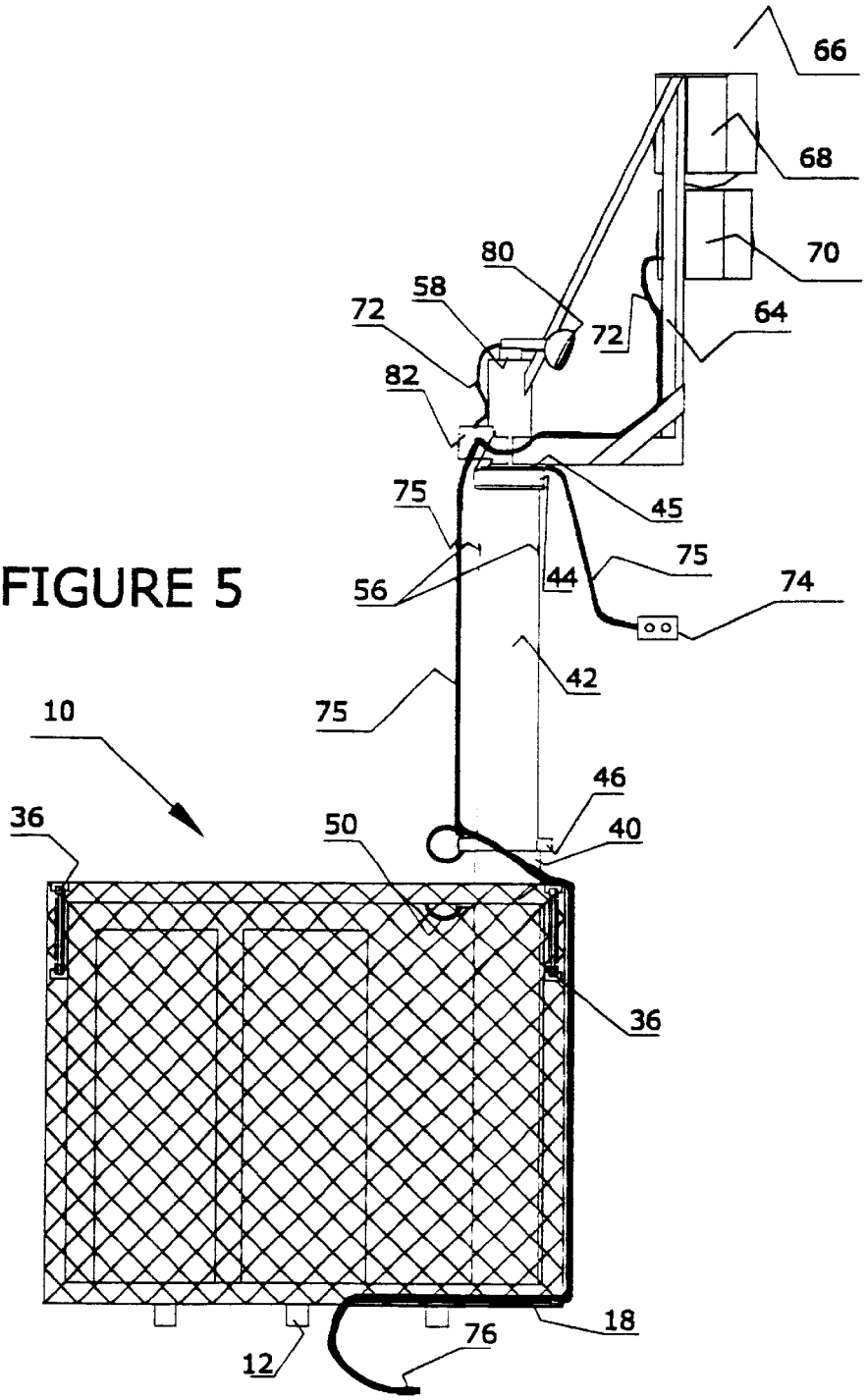
FIG. 5 is a front view of the unit.

Referring to the accompanying drawings, there is illustrated a safety unit 10. This unit includes a hitch connector 11 preferably comprising a hitch bar 12 that is dimensioned to fit into the square receiver tube 14 of a conventional receiver type hitch. As is usual with such a hitch, the receiver tube is held in position by a locking pin 16.

A carrier 18 is mounted on the hitch bar to extend across the back of a vehicle on which the hitch is mounted. The carrier has a rectangular base frame 20 supporting an expanded metal mesh bottom panel 22. Four standards 24 project upwardly from the corners of the base frame 20. These are joined at front and back sides of the carrier by two top cross members 25 and across one end by a cross member 26. At the end where the cross member 26 is located, the frame supports an expanded metal mesh end panel 27. At the front side of the carrier, confronting the vehicle hitch, the frame supports a front panel 28. On the opposite, back side, the frame supports a back panel 30. The front and back panels are, like the bottom and end panels, of expanded metal mesh.

The back panel of the carrier also supports a warning panel 31. This is a solid panel painted in a "checkerboard" warning panel with a set of black squares 32 spaced around the perimeter of the panel on a yellow background 34. Four handles 36 are mounted on the carrier for lifting and during mounting on or dismounting from the receiver tube 14. Two of the handles 36 are mounted on the back panel adjacent the ends and the other two handles are mounted on the front panel adjacent the ends.

A light unit 37 is mounted in the carrier, at the front corner adjacent the open end. This end is normally arranged to be on the driver's side of the vehicle on which the safety unit is carried so that when the vehicle is parked on the shoulder of a road, the standard is closest to the roadway. The light unit includes a standard 38 composed of a stationary outer tube 40 anchored to the carrier and an inner tube 42 that telescopes inside the outer tube. A collar 44 on the inner tube is dimensioned to abut the top end 45 of the outer tube 40 to limit the downwards movement of the inner tube 42 into the outer tube.

For use, the standard is raised so that the collar 44 is spaced above the top edge of the bottom tube 40. The standard is supported in the raised, in use position by a pin 46 through two diametrically opposed holes 48 in the inner tube 42. The pin rests on the top of the outer tube 40. To prevent relative rotation of the inner tube in the bottom tube in the raised position, a second pin 50 engages through two holes 52 in the outer tube 40 and two aligned holes 54 in the inner tube 42. This allows the inner tube to be raised to the in use height and supported by the pin 46 before the inner tube 42 is rotated to the in use position where the holes 52 and 54 align and the pin 50 is inserted. Two additional holes 56 in the inner tube 42 align with the holes 52 to receive the pin 50 in a lowered transport position of the standard, as will be described more fully in the following. A handle 57 is mounted on the inner tube for use in raising and rotating the inner tube to the in use position.

Adjacent the top of the standard, the inner tube 42 carries a bracket 58. This includes a horizontal lower arm and an upwardly and outwardly inclined upper arm 62, both supporting a vertical mounting bar offset laterally from the tube. A light head 66 is mounted on the vertical mounting bar 64. This includes a red light 68 mounted above an amber light 70. The bracket and light head are positioned on the inner tube so that in the in use position, the bracket projects laterally beyond the open side of the carrier and preferably beyond the driver's side of a vehicle on which the carrier is mounted. In the transport position, the inner tube is rotated 180° so that the light head is positioned behind the vehicle.

The electric circuit used to power the light head includes a wiring harness 72. The harness includes a hand held switch 74 on the end of a long multi-wire cable 75. The switch includes switches for turning on either the amber light 70 or the red light 68. The harness also includes a connector 76 for connection to a conventional trailer wiring connector 78 on the vehicle in order to power the lights. The amber light includes a flasher unit 82, illustrated schematically, for flashing the amber light on and off when it is powered.

The safety unit is completed with a set of floodlights 80 mounted on the bracket 58 for illuminating the ground surface below and to the side of the light unit 66. These lights are connected to the wiring harness 72 and are controlled by a switch on the remote control 74. They are used at night for illuminating the adjacent road area where a TCP would normally be standing to control the traffic.

To use this unit, it is simply picked up and mounted on the receiver hitch of a vehicle and connected to the trailer wiring connection of the vehicle. This takes very little time so that the unit can be on its way very quickly. On arrival at the site where it is to be used, the standard is raised, the pin 46 is inserted, the standard is rotated and the pin 50 is inserted and the unit is ready for use. Again, this procedure is carried out very quickly. A vehicle can travel along the road with the unit set up to follow travelling roadworks.

The carrier unit is conventionally equipped with all of the accessories that will be used in a roadside safety operation, including cones, shovels, picks and all the signage, poles with flags and the like. As a retainer, a chain or other enclosure may stand across the open end of the carrier as necessary, depending on the layout of the equipment in the carrier and the positioning and configuration of any supports or retainers that may be used.

While the foregoing describes one particular embodiment of the invention, it is to be understood that other embodiments are possible within the scope of the invention and that other accessory features may also be employed. In one other embodiment, the standard is not vertically extensible. This is particularly preferred where the operators of the unit may not have the necessary strength to lift the upper part of the standard along with the light unit. An alternative embodiment employs a mechanical extension mechanism, for example a winch cable arrangement for raising the upper end of the standard. A further accessory that can be employed is a supporting arrangement for supporting the safety unit at an appropriate height while the hitch bar is inserted into the receiver tube. This can be a set of collapsible legs on the carrier.

In view of the various modifications of the present invention that can be made within the scope of the invention, the invention is to be considered limited solely by the scope of the appended claims.

What is claimed is:

1. A roadwork safety unit for use with a road vehicle having a trailer hitch, a vehicle electrical system and a trailer wiring connector connected to the vehicle electrical system, said safety unit comprising:

a hitch connector for connection to the trailer hitch;

a light unit mounted on the hitch connector and including:
- an upright standard; and
- a light head mounted on the standard, the light head including at least two lights of different colors; and a light operating electric circuit connecting the electrical connector and the light head, the circuit including:
- an electrical connector connectable to the trailer wiring connector;
- a switch for selectively controlling the supply of electricity from the electrical connector to the light head for alternatively illuminating the lights.

2. A safety unit according to claim 1 including a base mounted on the hitch connector, the light unit being mounted on the base.

3. A safety unit according to claim 2 wherein the standard is offset to one side of the base with respect to the hitch connector.

4. A safety unit according to claim 2 wherein the base comprises a carrier mounted on the hitch connector.

5. A safety unit according to claim 4 including a warning panel mounted on the carrier, the warning panel having a checkerboard pattern thereon.

6. A safety unit according to claim 1 wherein the light unit includes a mounting bracket mounting the light head at a position laterally offset from the standard.

7. A safety unit according to claim 6 wherein the mounting bracket mounts the light head on the standard for rotation between a transport position above the base and a use position projecting to one side of the base.

8. A roadwork safety unit according to claim 1 wherein the standard is vertically extendable.

9. A safety unit according to claim 1 wherein the light head includes red and amber lights.

10. A safety unit according to claim 9 wherein the electrical light operating system includes a remote control operator for selective operation of the lights.

11. A safety unit according to claim 9 including a flasher unit for intermittently flashing the light.

12. A safety unit according to claim 1 wherein the light head includes at least one floodlight mounted on the standard.

* * * * *